US007768204B2

(12) United States Patent
Tokunaga et al.

(10) Patent No.: US 7,768,204 B2
(45) Date of Patent: Aug. 3, 2010

(54) ILLUMINATION DEVICE AND MANUFACTURING METHOD THEREOF

(75) Inventors: Seiichi Tokunaga, Suita (JP); Tatsuya Kunisato, Takatsuki (JP); Takenori Goto, Moriguchi (JP); Masayuki Hata, Kadoma (JP)

(73) Assignee: Sanyo Electric Co., Ltd. (JP)

( * ) Notice: Subject to any disclaimer, the term of this patent is extended or adjusted under 35 U.S.C. 154(b) by 373 days.

(21) Appl. No.: 11/710,405

(22) Filed: Feb. 26, 2007

(65) Prior Publication Data

US 2007/0228923 A1 Oct. 4, 2007

(30) Foreign Application Priority Data

Mar. 31, 2006 (JP) ..... 2006-100434

(51) Int. Cl.
*H01J 1/62* (2006.01)

(52) U.S. Cl. ..... 313/586; 313/310; 313/587; 257/100

(58) Field of Classification Search ..... 313/310, 313/586–587; 362/600; 345/83; 257/79
See application file for complete search history.

(56) References Cited

U.S. PATENT DOCUMENTS 5,998,925 A 12/1999 Shimizu et al.
6,144,352 A * 11/2000 Matsuda et al. ..... 345/83
2003/0080341 A1* 5/2003 Sakano et al. ..... 257/79
2005/0286264 A1* 12/2005 Kim et al. ..... 362/600

FOREIGN PATENT DOCUMENTS

JP 10-242513 9/1998
JP 2005-244076 9/2005

OTHER PUBLICATIONS

English Translation of JP2005-244076.*
English Translation of JP 2005-244076, published Sep. 8, 2005.*

* cited by examiner

*Primary Examiner*—Peter J Macchiarolo
*Assistant Examiner*—Mary Ellen Bowman
(74) *Attorney, Agent, or Firm*—NDQ&M Watchstone LLP

(57) ABSTRACT

Illumination device has a plurality of light emitting units, each with light emitting element and first fluorescent material region provided at a light emitting side of the light emitting element. A plurality of second fluorescent material regions are provided at the light emitting sides of respective light emitting units. Second fluorescent material regions having the same emission conversion property are respectively provided at the light emitting side of at least one light emitting unit having the same emission property among the plurality of light emitting units.

12 Claims, 2 Drawing Sheets

ILLUMINATION DEVICE AND MANUFACTURING METHOD THEREOF

CROSS REFERENCE TO RELATED APPLICATIONS

This application claims priority based on 35 USC 119 from prior Japanese Patent Application No. P2006-100434 filed on Mar. 31, 2006, the entire contents of which are incorporated herein by reference.

BACKGROUND OF THE INVENTION

1. Field of the Invention

The invention relates to an illumination device having a good emission distribution property and its manufacturing method.

2. Description of Related Art

Recently, illumination devices using light emitting elements such as light-emitting diode (LED) elements or organic EL elements have been explored to replace illuminating devices using fluorescent tubes. In such illuminating devices, fluorescent material regions that contain a fluorescent material are conventionally provided at the light emitting side of the light emitting elements. Light emitted from the light emitting elements are converted into light having a wavelength that is more favorably felt against human visibility by the fluorescent material contained in the fluorescent material regions and then emitted outside.

For example, Japanese patent Laid-Open No. 10-242513 describes an LED light emitting unit in which a fluorescent material region containing yttrium aluminum garnet phosphor activated with cerium is arranged at the light emitting side of an LED element composed of a nitride compound semiconductor element. In this LED luminescent device, part of the blue light emitted from the LED element is converted into yellow light by the fluorescent material and emitted outside as white light. Illumination devices with an increased luminescent area by providing numbers of such light emitting units that emit white light have also been considered. However, in the illumination device having an increased luminescent area by providing numbers of the above described light emitting units, there has been a problem that it was difficult to obtain an illumination device having a good emission distribution property.

More specifically, in Japanese patent Laid-Open No. 10-242513, the fluorescent material region is formed by curing an epoxy resin in which a $(RE_{1-x}Sm_x)_3(Al_yGa_{1-y})_5O_{12}$:Ce phosphor is scattered. However, in such a method that cures a resin material in which a fluorescent material is scattered, concentration of the fluorescent material varies for example because the fluorescent material sinks during the curing due to the difference of gravities between the fluorescent material and the resin material. The degree of variation also differs depending on the time from the preparation of the resin material in which a fluorescent material is scattered until the resin material is cured. Therefore, distribution and concentration of the fluorescent material in the formed fluorescent material regions tend to vary. In addition, it is difficult to make the amount of the resin material provided at the light emitting side of the LED element in which the fluorescent material is scattered uniform. As such, it was difficult to manufacture light emitting units having a desired color with good repeatability.

In an illumination device with an increased luminescent area by providing numbers of such light emitting units composed of a light emitting element and a fluorescent material region, as described above, the emission property of the light emitted from respective light emitting units such as its color varies because of the variation of concentration and distribution of the fluorescent material within the respective fluorescent material regions, and as a result, there was a problem that it was difficult to obtain an illumination device with a good emission distribution property.

SUMMARY OF THE INVENTION

One aspect of an illumination device according to an embodiment comprises a plurality of light emitting units, each of the light emitting units having a light emitting element and a first fluorescent material region containing a fluorescent material and provided at the light emitting side of the light emitting element; and a plurality of second fluorescent material regions containing a fluorescent material that are provided at the light emitting side of the respective light emitting units. The second fluorescent material regions having the same emission conversion property are respectively provided at the light emitting side of at least one light emitting unit having the same emission property among the plurality of light emitting units. Each of the second fluorescent material regions is preferably formed as a unit that can be handled in advance.

One aspect of a method of manufacturing an illuminating device according to an embodiment comprises forming a plurality of light emitting units, each of the light emitting units having a light emitting element and a first fluorescent material region containing a fluorescent material and provided at the light emitting side of the light emitting element; determining an emission property of the light emitting units and dividing the light emitting units into a plurality of groups, each of the plurality of groups containing at least one light emitting unit having the same emission property; and providing a plurality of second fluorescent material regions containing a fluorescent material such that the second fluorescent material regions having the same emission conversion property are respectively provided at the light emitting side of the light emitting units that have been grouped in the same group. Each of the second fluorescent material regions are preferably formed as a unit that can be handled in advance.

DETAILED DESCRIPTION OF EMBODIMENTS

Figure 1:
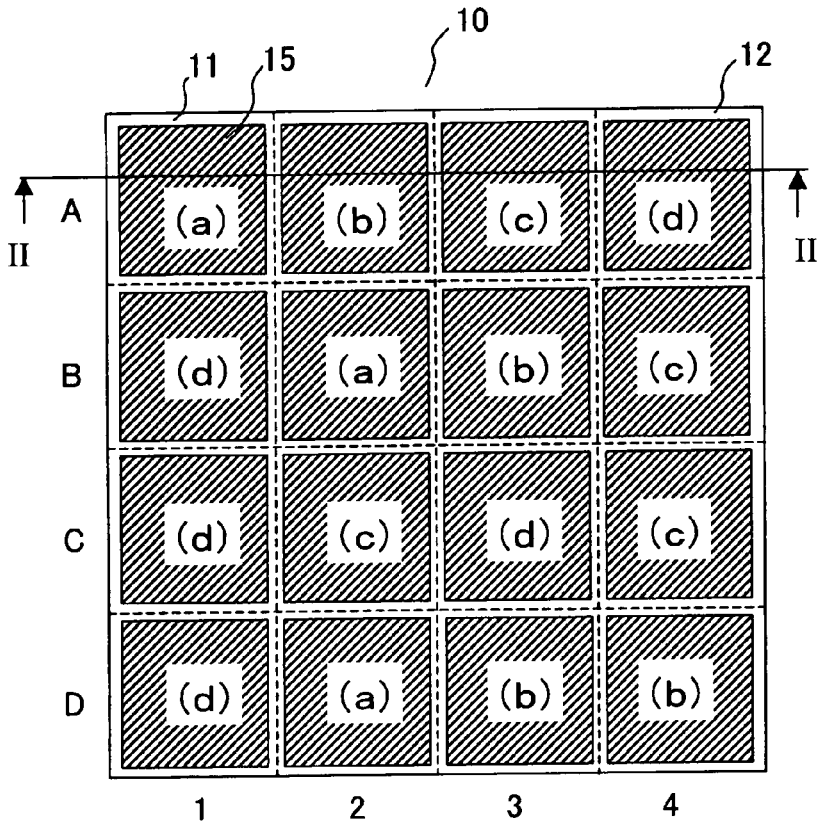
FIG. 1 is a top plan view of a representative illumination device according to one embodiment.
Figure 2:
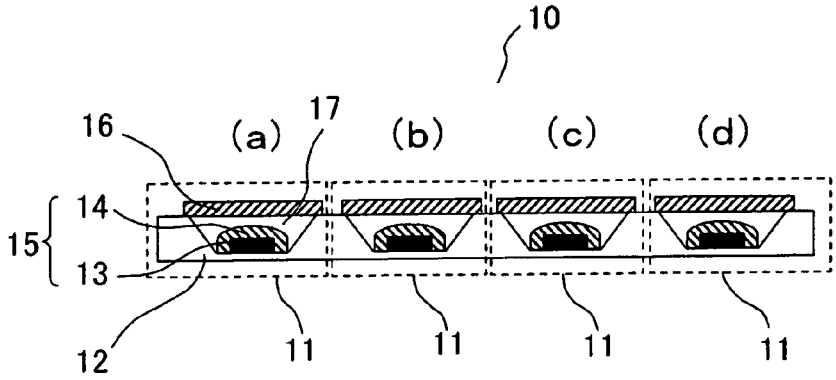
FIG. 2 is a cross sectional view taken along line II-II of FIG. 1.

Embodiments are described with reference to the accompanying drawings. FIG. 1 is a top plan view showing a frame format of illumination device 10 according to one embodiment. FIG. 2 is a cross sectional view taken along line II-II of FIG. 1.

As shown in FIG. 1, illumination device 10 comprises 16 luminescent devices 11 arranged in a matrix of four rows and four columns having rows: row A, row B, row C, and row D, and columns: column 1, column 2, column 3 and column 4. In FIG. 1, each luminescent device 11 is divided by dotted lines for illustration purposes.

As shown in FIG. 2, light emitting elements 13 on the base of substrates 12 have a reflective surface. First fluorescent material regions 14 containing a fluorescent material are provided at the light emitting side of light emitting elements 13. Light emitting elements 13 and first fluorescent material areas 14 constitute light emitting units 15 of the embodiment. Second fluorescent material regions 16 containing fluorescent material respectively are provided at the light emitting side of light emitting units 15, and light emitting units 15 and second fluorescent material regions 16 constitute luminescent devices 11 of this embodiment. In this embodiment, luminescent devices 11 are arranged in a 4-row×4-column matrix as described above. In FIGS. 1 and 2, electrical wiring connected to light emitting elements 13 is omitted.

As described above, an emission property of each light emitting unit 15 varies respectively. Second fluorescent material region 16 is provided at the light emitting side of each light emitting unit 15 in order to control this variation and improve uniformity of the emission distribution property of illumination device 10. In this embodiment, each light emitting unit 15 is sorted for example into one of four groups: group (a), group (b), group (c) and group (d) based on emission property. Representative emission property indicators generally are used for evaluating a light emitting element, such as emission intensity, emission peak wavelength, and chromaticity. When the embodiment is applied to an illumination device characterized by color shade such as a white light illumination device, an indicator for color shade such as chromaticity, is preferred for the emission property. For example, when chromaticity is used as an emission property, light emitting units 15, 15, . . . having similar chromaticity are grouped in the same group.

Second fluorescent material regions 16 have the same color conversion property and are provided at the plurality of light emitting units 15, which are grouped together. In this embodiment, second fluorescent material regions 16 having the same color conversion property are provided at the plurality of light emitting units, which are grouped together. Here, "the same color conversion property" that second fluorescent material regions 16 have is arbitrarily selected within an appropriate range according to the degree of emission distribution uniformity desired for the illumination device.

According to illumination device 10 of this embodiment, part of the emitted light from the plurality of light emitting units 15 that are grouped in the same group having similar emission properties is color-converted by second fluorescent material regions 16 having the same color conversion property and then taken out. As such, the light generally having the same emission property is taken out from the plurality of light emitting units 15, 15, . . . that are grouped in the same group. Therefore, by adjusting a color conversion property of second fluorescent material regions 16 selected for each group, an emission property of the light ultimately taken out from each of the luminescent devices 11, 11, . . . can be made to have a generally uniform property. Accordingly, an illumination device having a good emission distribution property is obtained.

As described above, an illumination device according to this embodiment has a second fluorescent material region 16 for adjusting the emission property, in addition to first fluorescent material region 14 provided at the light emitting side of light emitting element 13. The second fluorescent material region 16 makes the light property of the light ultimately emitted outside uniform. Therefore, it does not matter if the color conversion property of each light emitting unit 15, 15, . . . somewhat varies. According to this embodiment, an illumination device having a good emission distribution property can be produced with a simple manufacturing process control.

Each second fluorescent material region 16 preferably is formed as a unit, such as a sheet, that can be individually handled in advance, and such formed second fluorescent material region 16 as a unit is provided at the light emitting side of light emitting unit 15. In this way, an appropriate second fluorescent material region 16 can be selected from the plurality of second fluorescent material regions 16, 16, . . . that have been prepared in advance, and used to match the emission property of a given light emitting unit 15. Also, it is possible to sort out second fluorescent material regions 16 having similar color conversion properties in advance based on the respective color conversion properties among the plurality of second fluorescent material regions 16, 16, . . . previously formed in a sheet shape. By using such second fluorescent material regions 16 combined with light emitting unit 15, luminescent device 11 having a desired emission property can be easily produced. Because it becomes possible to reduce variation of each luminescent device's emission property, illumination device 10 in which numbers of such luminescent devices 11 are arranged that have uniform optical characteristics within light emission areas can be produced with good repeatability and improved process yield.

A first fluorescent material that comprises first fluorescent material region 14 and a second fluorescent material that comprises second fluorescent material region 16 can comprise the same or different materials. Concave portion 17 may be filled with resin that does not contain a fluorescent material, may be vacuum, filled with an inert gas or a liquid having high visible-light transmission.

Although light emitting units 15 were divided into four groups based on respective emission properties in this embodiment, the number of groups does not have to be four but can be set to any arbitrary number. Also, in this embodiment, an example was explained in which each of the four groups includes a plurality of light emitting units 15, 15, . . . , thus all groups may contain a plurality of light emitting units 15, 15, . . . . However, a group may consist of only one light emitting unit 15, or all light emitting units may be divided into different groups. Also, although an example was explained in which luminescent devices 11 having a planar quadrangle shape are arranged in a 4 row×4 column matrix, a plurality of luminescent devices having different planar shapes, for example, other polygonal shape such as a hexagonal shape, a circular shape, or an oval shape may be made according to embodiments.

Example 1 and Comparative Example 1

With reference to the drawings, illumination device 10 according to Example 1 will be explained below. In this example, a white light illumination device having the structure of FIGS. 1 and 2 and with a target chromaticity coordinates of (0.350, 0.380) will be explained. Comparative example 1 is an illumination device that has the structure of FIGS. 1 and 2 but without second fluorescent material regions 16, 16, . . . .

First, concave portions 17 for receiving each light emitting unit were formed on substrates 12 made of a heat-resistant material in a four row-four column matrix. Next, a near ultraviolet luminescent GaN LED chip having a peak emission wavelength of 390 nm to 410 nm was placed at the base of each concave portion 17 as light emitting element 13, and its anode and cathode were wired.

A mixed fluorescent material for color conversion was prepared by mixing known oxide products of a blue emission fluorescent material, green emission fluorescent material, and red emission fluorescent material with a mixing ratio of 25:35:40. Then, a first fluorescent material was prepared by mixing the above mixed fluorescent material into silicon resin such that the weight ratio of the mixed fluorescent material/resin became 20%, and fully diffusing the fluorescent material in the resin. Then, first fluorescent material regions 14 were formed by applying the first fluorescent material onto the LED chips so that the LED chips are fully buried, and then curing the first fluorescent material at 150° C. for an hour. Light emitting units 15, each composed of light emitting element 13 made of the LED chip and first fluorescent material region 14, were thus formed.

Chromaticity of each light emitting unit 15 was measured. The measurement results of the chromaticity coordinates (x, y) of each light emitting unit are shown in Table 1.

TABLE 1

| Row-Column | Chromaticity (Light emitting unit) x | y | Group |
|---|---|---|---|
| A-1 | 0.312 | 0.351 | (a) |
| A-2 | 0.352 | 0.358 | (b) |
| A-3 | 0.348 | 0.410 | (c) |
| A-4 | 0.377 | 0.398 | (d) |
| B-1 | 0.352 | 0.402 | (d) |
| B-2 | 0.330 | 0.333 | (a) |
| B-3 | 0.373 | 0.375 | (b) |
| B-4 | 0.312 | 0.385 | (c) |
| C-1 | 0.395 | 0.399 | (d) |
| C-2 | 0.343 | 0.420 | (c) |
| C-3 | 0.365 | 0.385 | (d) |
| C-4 | 0.343 | 0.382 | (c) |
| D-1 | 0.366 | 0.412 | (d) |
| D-2 | 0.320 | 0.350 | (a) |
| D-3 | 0.352 | 0.374 | (b) |
| D-4 | 0.360 | 0.346 | (b) |

Figure 3:
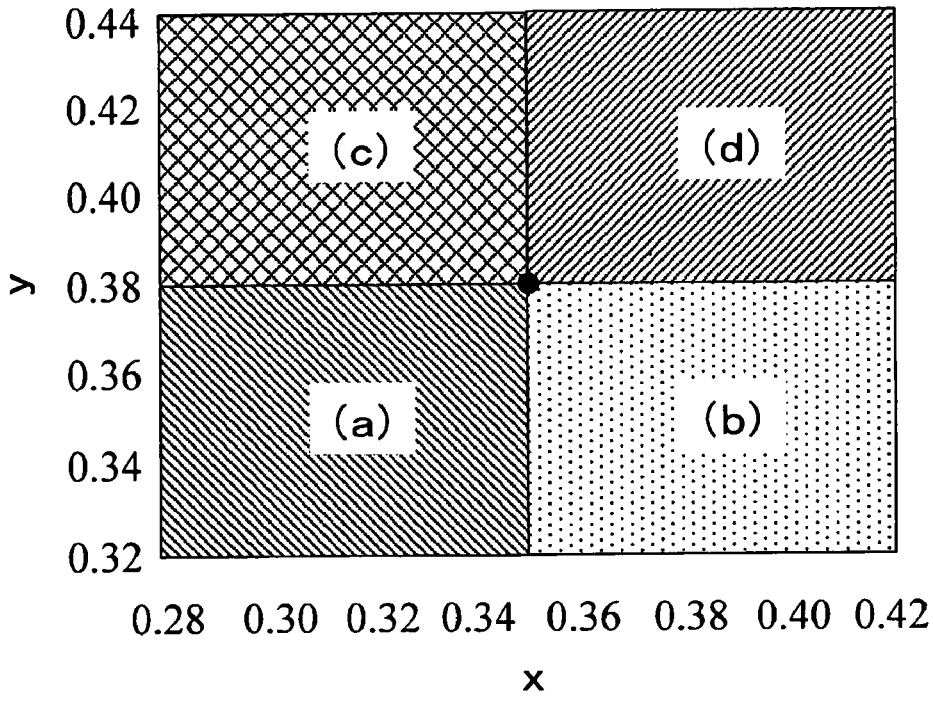
FIG. 3 is an explanatory view showing a frame format of grouping of light emitting units that comprise an illumination device according to one embodiment.

In this example, based on the measured chromaticity of each light emitting unit 15, each light emitting unit 15 was grouped into four groups. Because the target values of the chromaticity coordinates are (0.350, 0.380) in this example, each light emitting unit 15 was grouped into four groups based on whether or not its x coordinate value is larger than 0.350, and whether or not its y coordinate value is larger than 0.380. More specifically, as shown in FIG. 3, light emitting units 15 with x coordinates smaller than 0.350 and y coordinates smaller than 0.380 were grouped as group (a), light emitting units 15 with x coordinates larger than 0.350 and y coordinates smaller than 0.380 were grouped as group (b), light emitting units 15 with x coordinates smaller than 0.350 and y coordinates larger than 0.380 were grouped as group (c), and light emitting units 15 with x coordinates larger than 0.350 and y coordinates larger than 0.380 were grouped as group (d).

Next, silicon resin without fluorescent material was applied with concave portions 17 fully buried and the resin cured at 150° C. for an hour.

Next, a second fluorescent material was prepared from fluorescent material similar to the first fluorescent material and resin. The weight ratio of this mixed fluorescent material/resin become 20% and the fluorescent material was fully diffused in the resin. The second fluorescent material was then dropped onto a mold having an approximately 0.5 mm thickness, and heated at 150° C. for an hour to form a fluorescent material sheet. However, the chromaticity of the fluorescent material sheet was varied by changing the mixing ratios of the blue emission fluorescent material, the green emission fluorescent material, and the red emission fluorescent material that constituted the second fluorescent material to be combined for each group of light emitting units 15. The mixing ratios of the blue emission fluorescent material, the green emission fluorescent material, and the red emission fluorescent material, and their chromaticities (when excited at the wavelength of 405 nm) are shown in Table 2.

TABLE 2

| Group | Second fluorescent material Fluorescent material mixing ratio (%) Blue | Green | Red | Chromaticity of fluorescent material sheet (when excited at wavelength of 405 nm) x | y |
|---|---|---|---|---|---|
| (a) | 15 | 40 | 45 | 0.365 | 0.395 |
| (b) | 25 | 40 | 35 | 0.335 | 0.395 |
| (c) | 30 | 30 | 40 | 0.365 | 0.365 |
| (d) | 35 | 35 | 30 | 0.335 | 0.365 |

As can be understood from FIG. 3 and Table 2, a fluorescent material sheet having chromaticity of a reverse magnitude correlation between x and 0.350, and between y and 380, was combined. Here, the reverse magnitude correlation between x and 0.350, and between y and 380 is being reverse with respect to the magnitude correlation between the measured chromaticity coordinates (x, y) of each group of light emitting units 15 and the desired chromaticity coordinate of (0.350, 0.380).

Measured chromaticity of each luminescent device 11 formed by providing the above fluorescent sheet to the light emitting side of each light emitting unit as shown in Table 1 is shown in Table 3.

TABLE 3

| Row-Column | Chromaticity (Light emitting unit) x | y | Group | Chromaticity of fluorescent material sheet (when exited at wavelength of 405 nm) x | y | Chromaticity (Luminescent device) x | y |
|---|---|---|---|---|---|---|---|
| A-1 | 0.312 | 0.351 | (a) | 0.365 | 0.395 | 0.351 | 0.381 |
| A-2 | 0.352 | 0.358 | (b) | 0.335 | 0.395 | 0.359 | 0.377 |
| A-3 | 0.348 | 0.410 | (c) | 0.365 | 0.365 | 0.342 | 0.369 |
| A-4 | 0.377 | 0.398 | (d) | 0.335 | 0.365 | 0.354 | 0.388 |
| B-1 | 0.352 | 0.402 | (d) | 0.335 | 0.365 | 0.341 | 0.384 |

TABLE 3-continued

| Row-Column | Chromaticity (Light emitting unit) x | Chromaticity (Light emitting unit) y | Group | Chromaticity of fluorescent material sheet (when exited at wavelength of 405 nm) x | Chromaticity of fluorescent material sheet (when exited at wavelength of 405 nm) y | Chromaticity (Luminescent device) x | Chromaticity (Luminescent device) y |
|---|---|---|---|---|---|---|---|
| B-2 | 0.330 | 0.333 | (a) | 0.365 | 0.395 | 0.350 | 0.367 |
| B-3 | 0.373 | 0.375 | (b) | 0.335 | 0.395 | 0.359 | 0.365 |
| B-4 | 0.312 | 0.385 | (c) | 0.365 | 0.365 | 0.359 | 0.377 |
| C-1 | 0.395 | 0.399 | (d) | 0.335 | 0.365 | 0.345 | 0.395 |
| C-2 | 0.343 | 0.420 | (c) | 0.365 | 0.365 | 0.339 | 0.371 |
| C-3 | 0.365 | 0.385 | (d) | 0.335 | 0.365 | 0.346 | 0.382 |
| C-4 | 0.343 | 0.382 | (c) | 0.365 | 0.365 | 0.352 | 0.380 |
| D-1 | 0.366 | 0.412 | (d) | 0.335 | 0.365 | 0.356 | 0.375 |
| D-2 | 0.320 | 0.350 | (a) | 0.365 | 0.395 | 0.346 | 0.386 |
| D-3 | 0.352 | 0.374 | (b) | 0.335 | 0.395 | 0.360 | 0.373 |
| D-4 | 0.360 | 0.346 | (b) | 0.335 | 0.395 | 0.341 | 0.390 |

In Table 3, the light emitting unit has the structure of light emitting unit 15, which has the same structure as a conventional luminescent device (Comparative example 1), and the luminescent device is luminescent device 11 that constitutes an illumination device of the present invention (Example 1). The measured average chromaticity coordinates of the light emitting units are (0.350, 0.380), whereas the measured average chromaticity coordinates of the luminescent devices are also (0.350, 0.380).

From Table 3, it can be understood that chromaticity of the light emitted from the second fluorescent material regions, that is the chromaticity of luminescent devices 11, was made closer to the desired chromaticity by combining a fluorescent material sheet having a reverse magnitude correlation between x and 0.350, and between y and 380, with respect to the magnitude correlation between the measured chromaticity coordinates (x, y) of each group of light emitting units 15 and the desired chromaticity coordinate of (0.350, 0.380).

Also, the percentage of x falling in the range of 0.350±0.01, and of y falling in the range of 0.380±0.01 was 2 out of 16, i.e. 12.5% with the light emitting units, whereas the percentage with the luminescent devices was 12 out of 16, i.e. 75.0%. Therefore, the illumination device composed of a plurality of the above luminescent devices has considerably improved color uniformity of its emitting region, as compared with a conventional illumination device that is composed of a plurality of the above light emitting units. In this example, the x or y coordinates of no illumination device deviated more than ±0.02 from the target coordinates. As shown in the above example, an illumination device having good chromaticity distribution of the emitting region can be provided according to the illumination device of the present invention.

As described above, properties of the light that is ultimately emitted outside are made uniform by using the second fluorescent material regions for adjusting the emission property. Therefore, it is not a problem even if a color conversion property of each light emitting unit is somewhat non-uniform. Accordingly, illumination devices having a good emission distribution property can be provided by a simple method.

The present invention may be embodied in other specific forms without departing from the spirit or essential characteristics thereof. The embodiments are therefore to be considered in all respects as illustrative and not restrictive, the scope of the present invention being indicated by the appended claims rather than by the foregoing description, and all changes that come within the meaning and range of equivalency of the claims are therefore intended to be embraced therein.

For example, the above embodiment showed an example of applying the invention for a near ultraviolet emission GaN LED chip having a peak emission wavelength of 390 nm to 410 nm. However, the present invention may be used for other light emitting element such as an LED chip with a different peak emission wavelength or an organic EL element, and achieve similar effects. Also, the desired chromaticity coordinates of the illumination device were set as (0.350, 0.380) in the above explanation, but similar effects can be achieved for different target chromaticity coordinates.

Also, in the above explanation, chromaticity distribution of the emitting region was an example of an emission property. However, illumination devices according to the present invention achieve similar effects for other emission properties, such as emission intensity, emission peak wavelength, and emission spectrum.

What is claimed is:

1. An illumination device comprising:

a plurality of light emitting units, each of the light emitting units having a light emitting element and a first fluorescent material region containing a fluorescent material and provided at a light emitting side of the light emitting element;

a plurality of second fluorescent material regions containing a fluorescent material at a light emitting side of respective light emitting units, wherein the first fluorescent material region having a first emission conversion property, is provided at a light emitting side of at least one light emitting unit; and a second fluorescent material region, having a second emission conversion property that is different from the first emission conversion property, is provided at the light emitting side of at least one light emitting unit, wherein a chromaticity distribution of light emitted from the second fluorescent material regions is reduced from a chromaticity distribution of the light emitted from each light emitting unit.

2. The illumination device of claim 1, wherein the emission conversion property is color conversion.

3. The illumination device of claim 1, wherein the plurality of light emitting units are divided into a plurality of groups based on emission properties, and a plurality of the second fluorescent material regions having an emission conversion property that corresponds to each of the groups are provided at the light emitting sides of light emitting units for each corresponding group.

4. The illumination device of claim 1, wherein the plurality of light emitting units are sub-grouped according to differences of emission property from a desired emission property, and the second fluorescent material regions have emission conversion properties that correspond to each of the sub-groups and are provided at light emitting sides of the light emitting units of the corresponding sub-group.

5. The illumination device of claim 1, wherein the second fluorescent material regions are formed as a unit separated from the light emitting unit.

6. The illumination device of claim 1, wherein the second fluorescent material regions are formed in the shape of a sheet.

7. A method for manufacturing an illumination device, comprising:

forming a plurality of light emitting units, each of the light emitting units having a light emitting element and a first fluorescent material region containing a fluorescent material and provided at the light emitting side of the light emitting element;

determining an emission property of the light emitting units and dividing the light emitting units into a plurality of groups, each of the groups containing at least one light emitting unit having the same emission property; and providing a plurality of second fluorescent material regions containing a fluorescent material provided at the light emitting side of the light emitting units, wherein the first fluorescent material regions having a first emission conversion property are respectively provided at the light emitting side of at least one light emitting unit, and the second fluorescent material regions having a second emission conversion property are respectively provided at the light emitting side of at least one light emitting unit, and wherein a chromaticity distribution of the light emitted from each second fluorescent material region is reduced from a chromaticity distribution of the light emitted from each light emitting unit.

8. The method of claim 7, wherein the emission conversion property is color conversion.

9. The method of claim 7, further comprising the step of forming the second fluorescent material regions as a unit separated from the light emitting unit.

10. The method of claim 9, wherein the second fluorescent material regions that are formed as a unit are formed in the shape of a sheet.

11. The illumination device of claim 1, wherein the first fluorescent material region is placed on a surface of the light emitting element.

12. The method of claim 7, wherein the first fluorescent material region is placed on a surface of the light emitting element.

* * * * *